United States Patent [19]

Bennett et al.

[11] Patent Number: 5,042,855

[45] Date of Patent: Aug. 27, 1991

[54] ROTATIONAL CAM LATCH FOR VEHICLE WINDOW

[75] Inventors: Bruce A. Bennett, Cassopolis, Mich.; Raymond S. Butler, Elkhart; Todd E. Cripe, Goshen, both of Ind.

[73] Assignee: Excel Industries, Inc., Elkhart, Ind.

[21] Appl. No.: 548,755

[22] Filed: Jul. 2, 1990

[51] Int. Cl.[5] ..... E05C 3/04

[52] U.S. Cl. ..... 292/241; 292/DIG. 38; 292/DIG. 20; 292/190

[58] Field of Search ..... 292/190, 240, 241, 242, 292/DIG. 20, DIG. 38; 49/413

[56] References Cited

U.S. PATENT DOCUMENTS

| | | | |
|---|---|---|---|
| 373,143 | 11/1887 | Lister | 292/241 |
| 1,201,722 | 10/1916 | Haltfman | 292/241 |
| 3,811,718 | 5/1974 | Bates | 292/241 |
| 4,124,054 | 11/1978 | Spretnjak | 49/413 |
| 4,807,914 | 2/1989 | Fleming et al. | 292/240 |

FOREIGN PATENT DOCUMENTS

| | | | |
|---|---|---|---|
| 10821 | 5/1980 | European Pat. Off. | 292/241 |
| 159096 | 7/1940 | Fed. Rep. of Germany | 292/241 |
| 128153 | 3/1950 | Sweden | 292/241 |

*Primary Examiner*—Eric K. Nicholson
*Attorney, Agent, or Firm*—James D. Hall

[57] ABSTRACT

A latch for slidable window panels of a vehicle. The latch includes a rotatable handle carried by one window panel and a cam part carried by the other window panel. The handle engages the cam part as the handle is rotated to draw the slidable window panels together. The handle defines a narrowing channel which engages the cam part as the window handle is rotated from an open position to a locked position. The narrowing channel, formed by a thickening outer side wall of the handle, draws the cam and its connected window toward the handle. Detents are provided to impart a positive snap feel to the handle when rotated into either its opened or closed positions.

6 Claims, 4 Drawing Sheets

ROTATIONAL CAM LATCH FOR VEHICLE WINDOW

FIELD OF THE INVENTION

This invention relates to window latches and will have specific relevance to a rotary cam latch for a vehicle window.

BACKGROUND OF THE INVENTION

It is typical in vehicles, specifically pick-up trucks, to have a rear window which includes an opening for access to the truck bed and ventilation. It is also typical for such vehicles to include a pair of sliding window panels for spanning the rear window opening. The window panels may be locked to one another in the closed position. Heretofore, latches used to lock the sliding window panels together have been of a common over center latch and bail type. This type of latch requires the user, typically the driver, to turn partially toward the rear window to latch the windows together. Often, this requires the drivers to remove his eyes and attention from the road to operate the latch which is obviously dangerous and unacceptable.

SUMMARY OF THE INVENTION

The rotary latch of this invention eliminates the problems associated with the prior art window latches by providing a latch which has a rotatable handle part carried by one sliding window panel for rotative engagement with a cam part carried by the other sliding window panel. To impart the rotative movement to the handle the user simply reaches over his shoulder, grasps the rotatable part and twists the handle, which can be easily accomplished without removing his eyes from the road. Detents are included to frictionally maintain the handle part in either the latched or unlatched position. A camming surface is provided within the handle which engages the cam part to draw the two window panels tightly together and effectively seal the cab against moisture ingress.

Accordingly, it is an object of this invention to provide for a novel vehicle window latch.

Another object of this invention is to provide for a rotary latch for slidable vehicle window panels.

Another object of this invention is to provide for a cam operated rotary latch for slidable vehicle window panels.

Other objects of this invention will become apparent upon a reading of the following description taken with the accompanying drawings.

DESCRIPTION OF THE PREFERRED EMBODIMENT

The preferred embodiment herein disclosed is not intended to be exhaustive or to limit the application to the precise form disclosed. Rather it is chosen and described to enable others skilled in the art to utilize its teachings.

Figure 1:
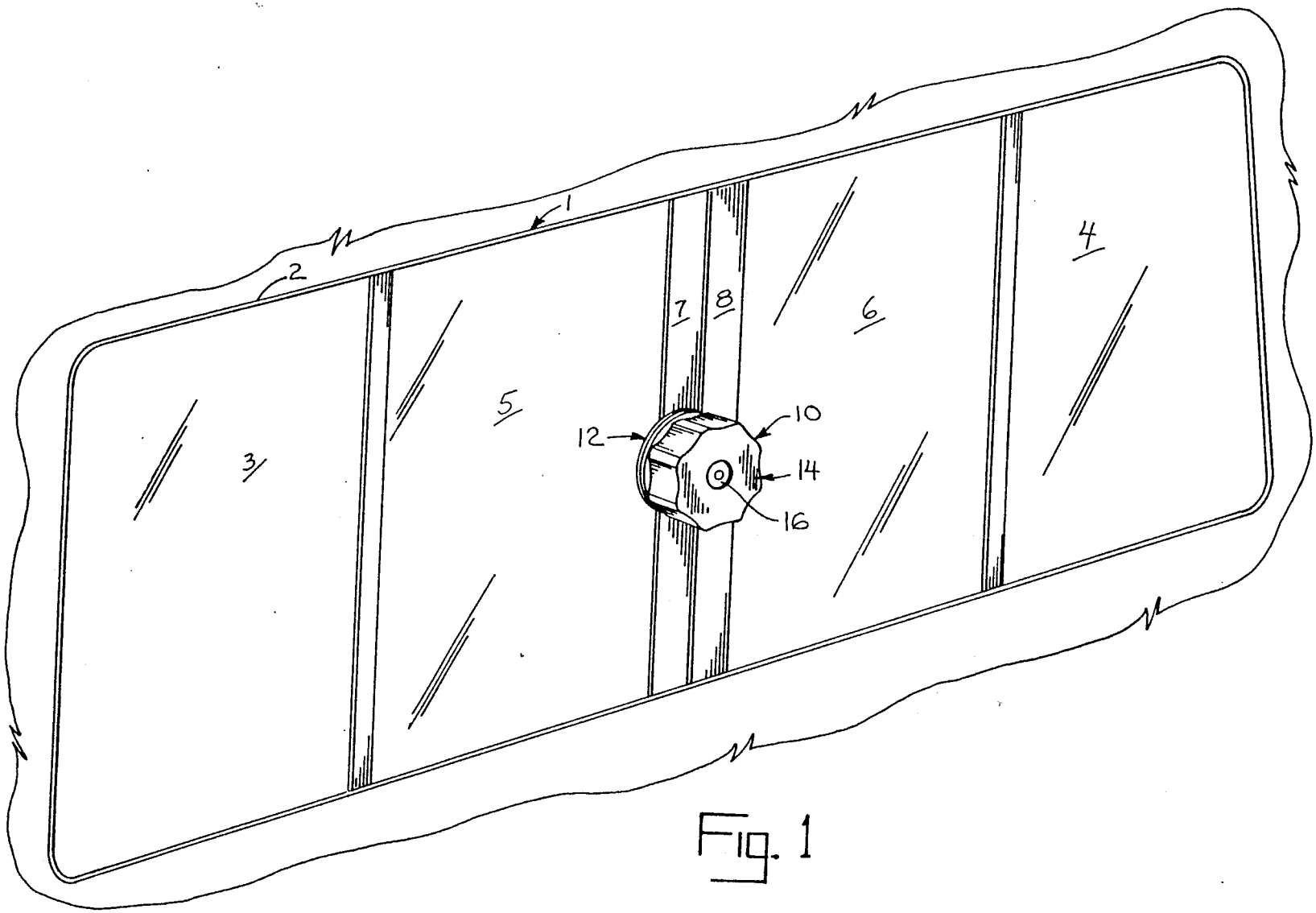
FIG. 1 is a perspective view of a typical vehicle rear window which includes two slidable window panels in use with the rotary cam latch of this invention.

Referring now to FIG. 1 a common rear vehicle window 1 is illustrated. Window 1 includes frame 2 and fixed window panels 8 and 4 carried by the frame at opposite longitudinal ends of the window. Fixed window panels 4 are spaced relative to one another to define an opening therebetween. Shiftable window panels 5, 6 are slidably carried within a pair of spaced channels of the frame so as to span the opening between panels 8, 4. Window panels 5, 6 include leading edging 7, 8 respectively for abutting engagement with one another to provide a weather tight seal between the window panels. Edging 7 as is common includes a flexible weather strip 9 (FIGS. 3 and 5) to further promote the weather tight seal between the shiftable window panels 5 and 6. The precise construction of window 1 is common in the industry and does not constitute a novel portion of this invention.

Rotary latch 10, as illustrated in the figures, includes a base 12 and a rotational handle 14 connected to window panel 5 at edging 7 by a fastener 16. Handle 14 is rotatable about fastener 16 relative to base 12. A flexible washer 17 is positioned between handle 14 and base 12 to provide resistive yieldable force between the handle and base. Base 12 is stationary relative to window panel 5 and includes a shoulder 18 which overlie the rear edge of edging 7 of panel 5 as shown in FIG. 3 to secure the base against rotation. Stop pins 20, 22 extend outwardly from base 12 and are radially spaced from fastener 16 as illustrated. Handle 14 includes as integral components a peripheral wall 24 and a central hub 26 interconnected by radial spokes 28, 80, 82, 34. Wall 24 has an opening 36 between spokes 28 and 34. Peripheral wall 24 has an inner surface 38, a portion 40 of which increases in thickness inwardly toward hub 26 with distance from opening 36 toward spoke 30 (see FIGS. 2 and 4). A notch 29 is formed through spoke 28 (see FIG. 6). A notch 31 is formed through spoke 30 as illustrated in FIG. 3 and a notch 33 is formed through spoke 32 as shown in FIG. 5. A rib 44 protrudes from wall portion 40. A detent 42 is formed in a base 12 along its arcuate edge 41 for accommodating rib 44 in a positive snap fit manner.

Figure 2:
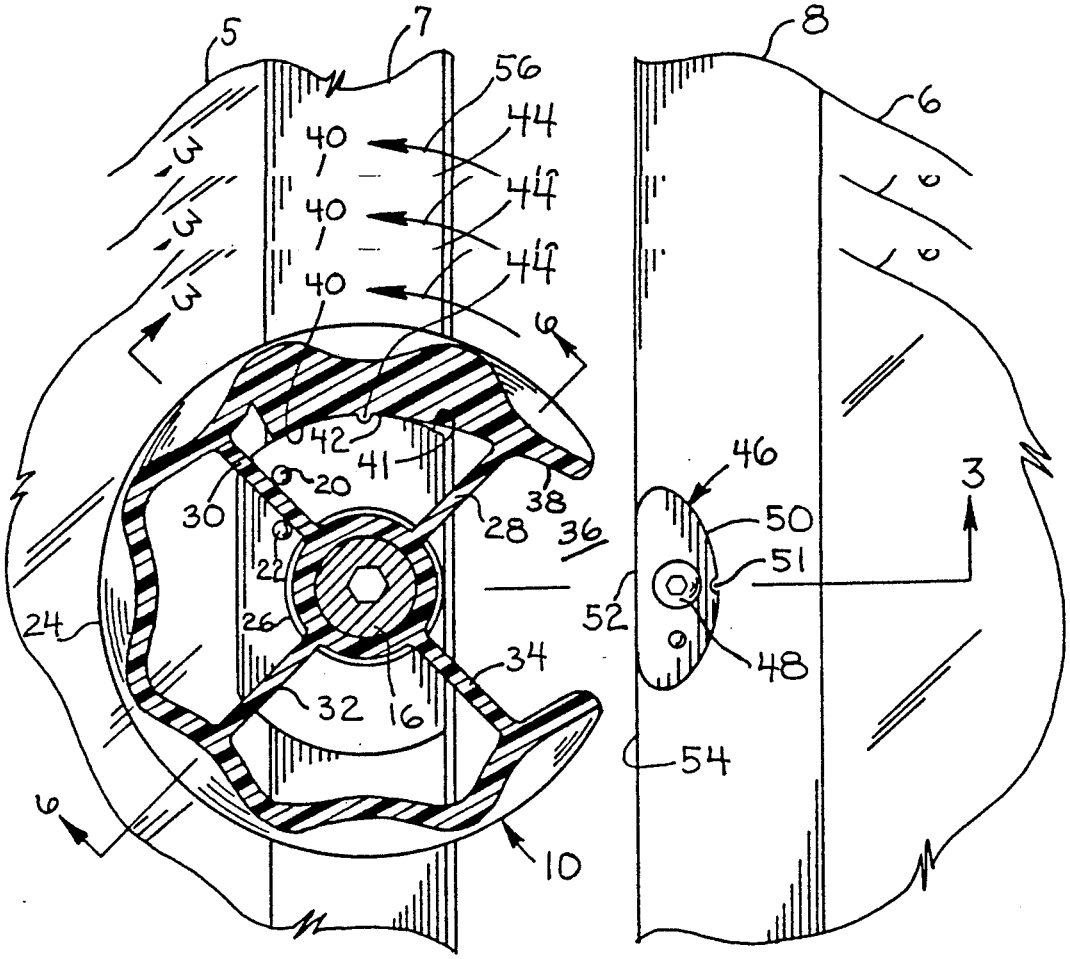
FIG. 2 is a sectional view of the latch shown in the unlatched position with the window panels separated.
Figure 3:
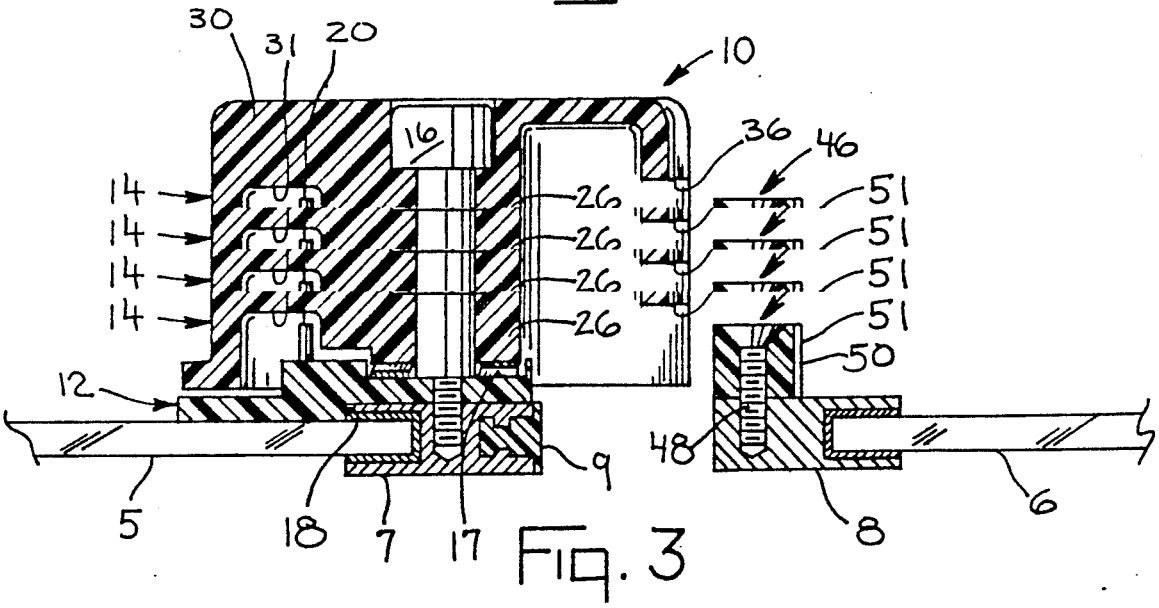
FIG. 3 is a cross sectional view taken from line 3—3 of FIG. 2.
Figure 4:
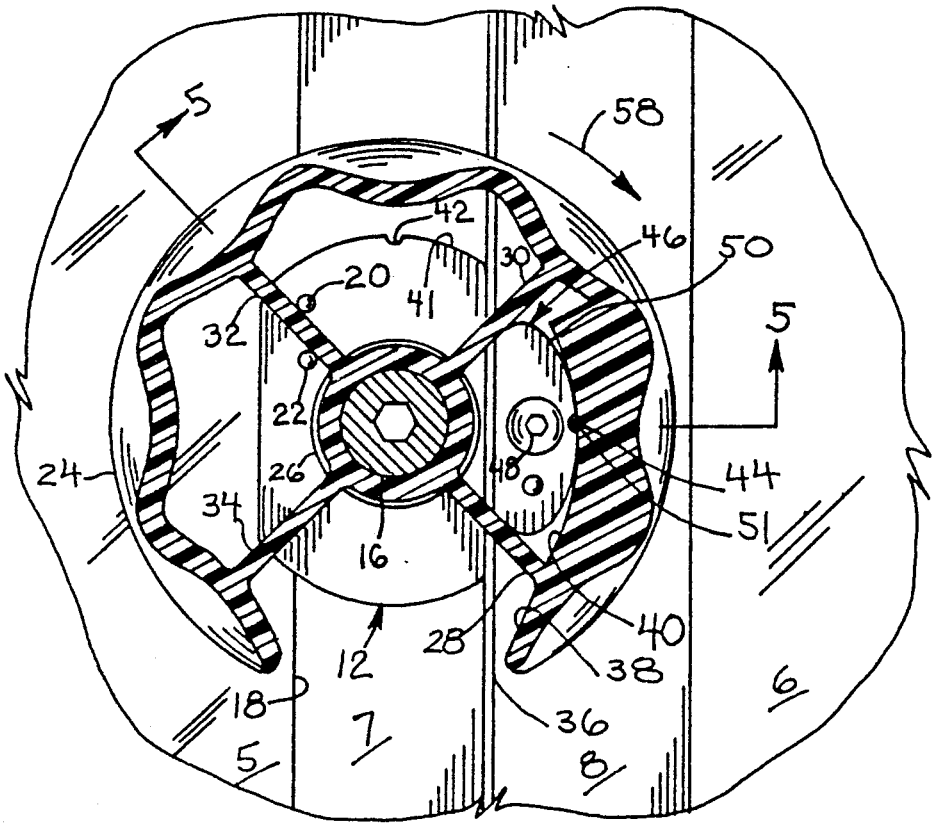
FIG. 4 is a sectional view of the latch shown in the latched position with the window panels together.
Figure 5:
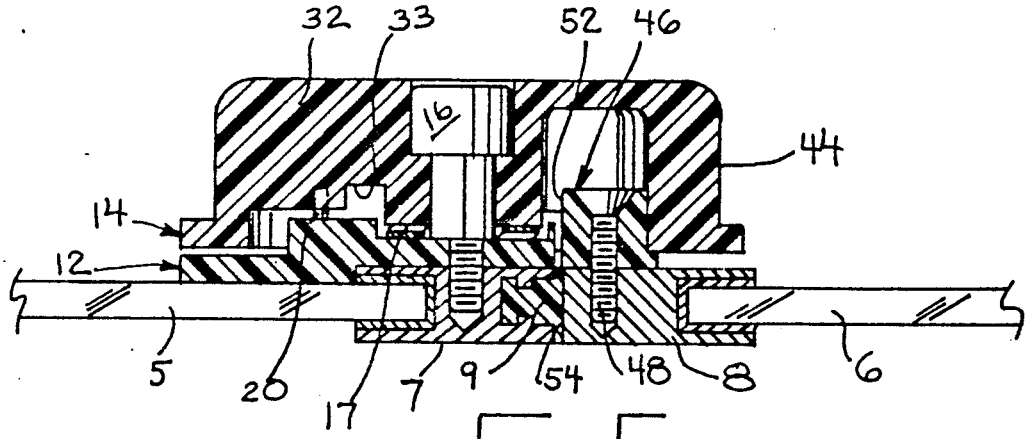
FIG. 5 is a sectional view taken along line 5—5 of FIG. 4.
Figure 6:
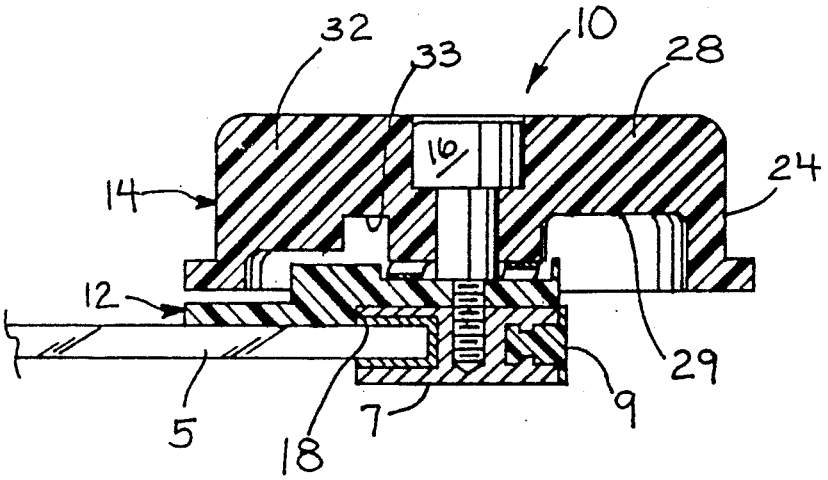
FIG. 6 is a sectional view taken along line 6—6 of FIG. 2.

Handle 14 is rotatable 90° between the open position of FIGS. 2, 3 and 6 and the closed position of FIGS. 4 and 5. Stop pins 20, 22 define the rotational limits for the handle in conjunction with radial spokes 30, 32 to define its fully open and closed positions. As illustrated, when handle 14 is rotated in the direction of arrow 56 into its open position, spoke 30 contacts pin 22 to prevent further opening rotation of the handle. With handle 14 in its fully open position of FIG. 2, rib 44 is accommodated within detent 42 of base 12 and provides a positive snap lock feel to the handle. As illustrated best in FIG. 3, notch 31 in spoke 30 is aligned with stop pin 20 to allow the handle to rotate past pin 20 in the direction of arrow 58 towards its closed position. Spoke 32 abuts pin 20 when the handle is rotated in the direction of arrow 58 into its closed position of FIG. 4. The notch 33 in spoke 32 is aligned with stop pin 22 to allow the handle to rotate past pin 22 in the direction of arrow 58. A notch 29 is formed through spoke 28 to accommodate cam part 46 as handle 14 is rotated into its closed position of FIGS. 4 and 5.

A cam part 46 is connected to slidable window panel 6 at edging 8 by screw 48. Cam part 46 includes an arcuate rear wall 50 and a flat front wall 52. A detent 51 is formed in rear wall 50. Cam part 46 is so positioned on edging 8 of window panel 6 such that the flat front wall 52 of the cam part is flush with the outer edge 54 of edging 8.

In use with window panels 5, 6 initially open as shown in FIGS. 2 and 3, handle 14 is maintained in its open position by rib 44 being seated in detent 42 as described earlier to align opening 36 with cam part 46 on window panel 6. To lock the windows closed, panels 5, 6 are slid so that edgings 7, 8 are in close proximity to one another. With panels 7, 8 so positioned, cam part 46 is located within opening 36 of handle 14. The user then rotates handle 14 in the direction of arrow 58. During rotation, inner wall portion 40 of handle 14 contacts arcuate rear wall 50 of cam part 46. Continued rotation of handle 14 in the direction of arrow 58 cams cam part 50 and base 12 toward each other to draw window panels 5, 6 together and compress weather striping 9 to promote a weather proof seal between edging 7, 8 of the window panels. Rib 44 of handle 14 is seated within detent 51 formed in cam part rear wall 50 to provide a positive snap lock feel when the handle is rotated into its fully closed position. To open window panels 5, 6, handle 14 is rotated in the direction of arrow 56 seen in FIG. 2, to align opening 36 with cam part 46 until spoke 30 contacts pin 22 and rib 44 seats in base detent 42. Panels 5, 6 may now be opened.

It should be understood that the invention is not to be limited to the precise forms disclosed but may be modified within the scope of the appended claims.

I claim:

1. A rotational cam latch in combination with a window, said window being slidable within a frame and including a leading edging, said window being slidable within said frame between open position wherein said edging is spaced from an edging of an adjacent structure and a closed position wherein said window edging is adjacent said structure edging, said latch comprising a base fixedly connected to said window adjacent its said edging, a cam part connected to said structure adjacent its said edging, said latch including a handle rotatably connected to said base and shiftable between open and closed positions, said handle having an outer wall, an opening in said outer wall part alignable with said cam part when the handle is in its said open position, said cam part projecting through said wall part opening into said handle when said window is in its closed position, said latch and cam part cooperating to draw said window tightly against said structure when the handle is turned into its closed position with said window in its closed position, said handle including a plurality of spoke parts extending radially from a central hub to said outer wall part, a channel means formed between said hub and the outer wall part for receiving said cam part when said cam part is in its closed position, said wall part opening formed between an adjacent pair of spokes, one of said spokes spanning said channel and having a notch means for accommodating passage therethrough of said cam part as said handle is rotated into its closed position.

2. The rotational cam latch of claim 1 wherein said cam part includes an arcuate wall, said outer wall part of the handle contacting and overlying said arcuate wall when said handle is in its closed position.

3. The rotational cam latch of claim 1 wherein said channel formed between said shaft and outer wall part narrows with distance from said opening.

4. The rotational cam latch of claim 1 and further including stop means connected to said base for engaging said spokes to locate said handle in its said open and closed positions.

5. The rotational cam latch of claim 4 wherein said stop means includes a pin means extending from said base toward said handle for contacting a said spoke as said handle rotates into its closed position, an adjacent spoke to said last mentioned spoke including a notch for accommodating passage therethrough of said pin as said handle is rotated from its open toward its closed position.

6. The rotational cam latch of claim 5 wherein said stop means includes a second pin means extending from said base toward said handle for contacting said adjacent spoke as said handle rotates into its open position, said handle being rotatable about an axis extending through said hub, said second pin means being radially offset from said handle axis relative to said first mentioned pin means, said spoke contacted by first mentioned pin means including a notch for accommodating passage therethrough of said second pin as said handle rotates from its closed position towards its open position.

* * * * *